US005234548A

United States Patent [19]

Hatton

[11] Patent Number: 5,234,548

[45] Date of Patent: Aug. 10, 1993

[54] PRODUCTION OF PAPER AND PAPERBOARD

[75] Inventor: William Hatton, Northwich, England

[73] Assignee: Vinings Industries Inc., Atlanta, Ga.

[21] Appl. No.: 815,977

[22] Filed: Jan. 2, 1992

[51] Int. Cl.[5] ..... D21H 21/10

[52] U.S. Cl. ..... 162/168.3; 162/181.8; 162/183

[58] Field of Search ..... 162/168.2, 168.3, 181.8, 162/183, 164.6, 168.1, 164.1

[56] References Cited

U.S. PATENT DOCUMENTS

| | | | |
|---|---|---|---|
| 3,052,595 | 9/1962 | Pye | 162/181.8 |
| 4,305,781 | 12/1981 | Langley et al. | 162/181.8 |
| 4,749,444 | 6/1988 | Lorz et al. | 162/181.8 |
| 5,032,227 | 7/1991 | Derrick et al. | 162/168.3 |

*Primary Examiner*—Peter Chin

*Attorney, Agent, or Firm*—Kane, Dalsimer, Sullivan, Kurucz, Levy, Bisele and Richard

[57] ABSTRACT

Paper or paperboard is made by forming an aqueous cellulosic suspension, passing the cellulosic suspension through one or more shear stages, draining the suspension to form a sheet and drying the sheet, wherein the cellulosic suspension that is drained includes organic polymeric material and inorganic material, wherein said organic polymeric material is a flocculant having a molecular weight above 500,000 and is added to the suspension before one of the said shear stages and wherein said inorganic material comprises bentonite which added to the suspension after that shear stage, characterised in that the organic polymeric material comprises an anionic or non-ionic polymer.

6 Claims, No Drawings

PRODUCTION OF PAPER AND PAPERBOARD

BACKGROUND OF THE INVENTION

1. Field of the Invention

This invention concerns the production of paper and paperboard.

2. Brief Description of Related Art

Conventional paper or paperboard manufacture involves forming a fibrous stock containing additives such as pigments, fillers and sizing agents and dewatering the stock on a metal or fabric wire to form the basis for the paper or board sheet. Such processes have been subject to the conflicting requirements that ready drainage of the stock should occur and that there should not be undue loss of additives and of fibre from the stock in the course of drainage, that is, that the retention of such additives and fibre on the wire should be high. This acts not only to give a saving in raw material costs and a reduction in the energy required to dry the sheet but also reduces effluent treatment requirements as a result of a lower content of suspended solids, and lower COD and BOD loadings, in the purge water. Sheet formation and surface properties may also be improved. There have been many attempts to optimise drainage and retention properties by the use of combinations of additives, which include polyelectrolytes such as high molecular weight polyacrylamide and its copolymers, which act as flocculants.

It has been proposed to use colloidal swelling clays in conjunction with the high molecular weight, relatively low charge density polyacrylamides which have traditionally been used as flocculants, which may be non-ionic, anionic or cationic in nature and may be selected to suit the charge demand of the stock.

U.S. Pat. No. 3,052,595, for example, discloses the addition of bentonite to filled stock followed by an acrylamide homopolymer or copolymer which may include at most about 15% by weight of a functional comonomer which may be anionic or cationic in nature, corresponding to a charge density of at most about 2 m.eq./g. The affect of the above combination is that the polymer and the bentonite "are mutually activating whereby increased retention of the filler in the paper web and decreased turbidity of the resulting white water are obtained".

More recently, EP-A-0017253 disclosed that the fibre retention and dewatering properties of substantially filler-free stocks may be improved dramatically by including in the stock a high molecular weight polyacrylamide and a bentonite-type clay. The polyacrylamide may contain not more than 10% of either cationic or anionic units and is limited thereby to low charge density material.

U.S. Pat. Nos. 4,753,710 and 4,913,775 disclose a process, the Hydrocol process, comprising adding a high molecular weight linear cationic polymer to thin stock to form large flocs, subjecting the flocculated suspension to significant shear and adding bentonite to the sheared suspension. It is explained that the effect of shearing is to break the flocs down into microflocs which are sufficiently stable to resist further degradation. A further and more detailed explanation of the Hydrocol process mechanics is provided by the inventor in TAPPI Proceedings, 1986 Papermakers Conference, pages 89–92. On page 90, it is noted that the inventor states that the "key to achieve supercoagulation is to balance the charges and surface area of the pre-treated stock with the charge and surface area of the secondary addition". Furthermore, on column 10, lines 26–43, of U.S. Pat. No. 4,753,710 and column 10, lines 59–66, of U.S. Pat. No. 4,913,775, it is stated that in the process it is essential to use a cationic polymer as the flocculant, rather than a non-ionic or anionic polymer.

It is an object of the present invention to provide a process for making paper and paperboard in which the drainage and retention properties of the stock are modified.

SUMMARY OF THE INVENTION

According to the present invention, paper or paperboard is made by forming an aqueous cellulosic suspension, passing the cellulosic suspension through one or more shear stages, draining the suspension to form a sheet and drying the sheet, wherein the cellulosic suspension that is drained includes organic polymeric material and inorganic material, wherein said organic polymeric material is a flocculant having a molecular weight above 500,000 is added to the suspension before one of the said shear stages and wherein said inorganic material comprises bentonite which added to the suspension after that shear stage, characterised in that the organic polymeric material comprises a synthetic anionic or non-ionic polymer. Preferably the organic polymer comprises an anionic polymer. The process of the present invention gives an improvement in retention and/or drainage properties comparable with the improvement in properties attained by use of the prior art Hydrocol process, which is surprising when U.S. Pat. Nos. 4,753,710 and 4,913,775 categorically teach that a cationic polymer must be used rather than a non-ionic or anionic polymer and when the charges in the flocculated stock are put further out of balance by the later addition of bentonite.

DETAILED DESCRIPTION OF THE INVENTION

The amount of bentonite added is generally in the range disclosed on column 10, lines 44 to 46, of U.S. Pat. No. 4,753,710. The bentonite used in the present invention can be any of the anionic swelling clays disclosed on column 10, line 47, to column 11, line 2, of U.S. Pat. No. 4,753,710. The bentonite can have a dry particle size as disclosed on column 11, lines 3 to 11, of U.S. Pat. No. 4,753,710. The bentonite is generally added to the aqueous suspension in the form disclosed on column 11, line 12 to 16, of U.S. Pat. No. 4,753,710.

The amount of bentonite that has to be added is generally in the range 0.03 to 0.5%, preferably 0.05 to 0.3% and most preferably 0.08 or 0.1 to 0.2%.

The bentonite can be any of the materials commercially referred to as bentonites or as bentonite-type clays, i.e., anionic swelling clays such as sepialite, attapulgite or, preferably, montmorillonite. The montmorilonites are preferred. Bentonites broadly as described in U.S. Pat. No. 4,305,781 are suitable.

Suitable montmorillonite clays include Wyoming bentonite or Fullers Earth. The clays may or may not be chemically modified, e.g., by alkali treatment to convert calcium bentonite to alkali metal bentonite.

The swelling clays are usually metal silicates wherein the metal comprises a metal selected from aluminum and magnesium, and optionally other metals, and the ratio silicon atoms:metal atoms in the surface of the clay particles, and generally throughout their structure, is from 5:1 to 1:1. For most montmorillonites the ratio is relatively low, with most or all of the metal being aluminum but with some magnesium and sometimes with, for instance, a little iron. In other swelling clays however, some or all of the aluminum is replaced by magnesium and the ratio may be very low, for instance about 1.5 in sepialite. The use of silicates in which some of the aluminum has been replaced by iron seems to be particularly desirable.

The dry particle size of the bentonite is preferably at least 90% below 100 microns, and most preferably at least 60% below 50 microns (dry size). The surface area of the bentonite before swelling is preferably at least 30 and generally at least 50, typically 60 to 90, $m^2/gm$ and the surface area after swelling is preferably 400–800 $m^2/g$. The bentonite preferably swells by at least 15 or 20 times. The particle size after swelling is preferably at least 90% below 2 microns.

The bentonite is generally added to the aqueous suspension as a hydrated suspension in water, typically at a concentration between 1% and 10% by weight. The hydrated suspension is usually made by dispersing powdered bentonite in water.

The organic polymer has a molecular weight above 500,000, preferably above 1 million and more preferably above 5 million, such as in the range 10 to 30 million or more.

The anionic polymer is a homopolymer or copolymer and more preferably is a partially hydrolysed homopolymer of acrylamide, acrylonitrile or methacrylamide monomers, a partially hydrolysed copolymer of the same monomers alone or a copolymer of the same monomers and acrylic acid and/or methacrylic acid monomers. Particularly suitable polymers include hydrolysed polymers of acrylamide, acrylonitrile and methacrylamide, hydrolysed copolymers of the same monomers, copolymers of acrylamide acrylonitrile and/or methacrylamide and acrylic acid and/or methacrylic acid. The alkali metal or alkaline earth metal salts of the polymers are also of use in this invention.

The anionic polymer preferably has a relatively low charge density. For example, the charge density of the polymer is preferably below 5 equivalents per kilogram of polymer, more preferably 0.01 to 4, and yet more preferably 0.05 to 3.5.

The non-ionic polymer is a homopolymer or copolymer and is preferably a non-hydrolysed polymer, including homopolymers and copoloymers, of acrylamide, methacrylamide, or acrylonitrile or a polyalkoxylate formed from, for example, the condensation of ethylene oxide, propylene oxide or butylene oxides or mixtures thereof.

The amount of organic polymer used in the present invention is preferably more than 0.005%, but preferably less than 0.25%, based on the weight of dry stock. Typically, the dosage of polymer will normally be from 0.01% to 0.2%, preferably from 0.01 to 0.1% and more preferably from 0.02 to 0.07%.

The shearing stage may be obtained by passing the stock through a cleaning, mixing or pumping stage. Passing the stock through a centriscreen is particularly advantageous, though simple turbulence mixing obtainable by passing the stock along a length of pipeline may be just as effective.

Preferably, before addition of the polymer, the cellulosic suspension carries a neutral or anionic demand. Preferably, the cellulosic suspension carries an anionic demand.

In one embodiment of the present invention, the stock is initially dosed with a cationic donor, such as alum or most preferably a low molecular weight cationic polymer. The polymeric donor is preferably used in an amount of from 0.01% to 0.25% active product based on stock solids. Typically, such cationic polymeric donors have low molecular weight, e.g. less than 200000, preferably less than 20000, and carry a high cationic charge, e.g. above 70% of the monomers used to form the polymer carry a cationic charge. Polyamines, polyquaternaryamines and polyimidoamine are most preferred, especially homopolymers of amines.

The invention is preferably utilised in cationic papermaking systems, which are preferably alkaline or neutral in nature, for the production of writing and printing papers, bond and bank grades, newsprint, linear board, security and computer paper, photocopy paper, sack paper, filler board, white lined carbon, wrapping/packaging paper, plasterboard, box board, corrugated board, towelling and tissue paper.

Other additives usually used in the manufacture of paper or paperboard are compatible with the present invention. Among such additive are fillers, clays (non-swelling), pigments such as titanium dioxide, precipitated/ground calcite, gypsum, sizes such as rosin/alum or synthetic sizes such as the alkylketene dimers or alkyl succinic anhydrides, wet or dry strength resins, dyes, optical brighteners and slimicides.

The present invention will now be illustrated with reference to the following tests in which the performance of the present invention was compared with the conventional use of polymeric flocculants.

A standard volume of a fine paper stock was introduced into a standard Britt Jar apparatus (for measuring fine retention—TAPPI Method T261, 1980) and an anionic flocculant introduced in a given quantity followed by mixing under high shear conditions (1500 rpm) for 30 seconds. After this mixing stage in some tests a given quantity of a commercial swelling clay was added in the form of an aqueous suspension comprising 10 g/l clay. The clay was mixed in by low shear for 15 seconds and the retention tests performed to give results expressed as % fines retained by weight of originally present fines.

The results on two different batches of fine paper stock, having a pH of 7.2 and an anionic demand, are given below:

| Retention study results: | | |
|---|---|---|
| Headbox consistency | 0.74% | |
| Fines fraction | 46% | |
| | % Fines Retention | |
| | Batch 1 | Batch 2 |
| Blank | 76 | 51 |
| Percol[1] 110L @ 2 lb/ton | 82 | 85 |
| Percol 110L @ 2 lb/ton plus Hydrocol O[2] @ 4 lb/ton | 86 | 87 |

[1]Percol 110L is a high molecular weight anionic polymeric flocculant available from Allied Colloids.
[2]Hydrocol O is a bentonite clay available from Allied Colloids.

The above results indicate a surprising improvement in retention properties of stocks treated in accordance with the present invention.

I claim:

1. A process for the manufacture of paper or paperboard, which comprises;

forming an aqueous cellulosic suspension, passing the cellulosic suspension through one or more shear stages, draining the suspension to form a sheet and drying the sheet, wherein the cellulosic suspension that is drained includes from more than 0.005 percent to less than 0.25 percent, based on the weight of dry sheet, of an organic polymeric material and from 0.03 to 0.5 percent of an inorganic material, wherein said organic polymeric material is a polyacrylamide flocculent having a molecular weight above 500,000 and is added to the suspension before one of the shear stages and wherein said inorganic material comprises bentonite which is added to the suspension after the shear stage, and wherein the organic polymeric material comprises an anionic or non-ionic polymer.

2. A process as claimed in claim 1, wherein the organic polymeric material is an anionic polymer.

3. A process as claimed in claim 2, wherein the organic polymeric material is a polymer of acrylamide and/or methacrylamide monomers.

4. A process as claimed in claim 3, wherein the polymer is a copolymer of acrylic and/or methacrylic acid monomers.

5. A process as claimed in claim 1, wherein the cellulosic suspension is treated with a cationic donor before the suspension is treated with the organic polymeric material.

6. A process as claimed in claim 1, wherein, before the cellulosic suspension is treated with the organic polymeric material, the suspension carries an anionic demand.

* * * * *